US008001748B2

(12) United States Patent
Schulz et al.

(10) Patent No.: US 8,001,748 B2
(45) Date of Patent: Aug. 23, 2011

(54) METHOD OF TESTING, DETERMINING, AND ADJUSTING A FINAL CLOSING TORQUE OF A BEVERAGE BOTTLE OR CONTAINER CLOSING MACHINE AND AN APPARATUS FOR PERFORMING THE METHOD

(75) Inventors: Enrico Schulz, Munich (DE); Karl Lorenz, Niederhausen (DE)

(73) Assignee: KHS AG, Dortmund (DE)

( * ) Notice: Subject to any disclaimer, the term of this patent is extended or adjusted under 35 U.S.C. 154(b) by 181 days.

(21) Appl. No.: 12/325,066

(22) Filed: Nov. 28, 2008

(65) Prior Publication Data

US 2009/0293437 A1 Dec. 3, 2009

Related U.S. Application Data

(63) Continuation-in-part of application No. PCT/EP2007/004538, filed on May 23, 2007.

(30) Foreign Application Priority Data

May 31, 2006 (DE) ..... 10 2006 025 811

(51) Int. Cl.
*B65B 7/28* (2006.01)

(52) U.S. Cl. ..... 53/471; 53/331.5

(58) Field of Classification Search ..... 53/471, 53/490, 331.5, 317, 75
See application file for complete search history.

(56) References Cited

U.S. PATENT DOCUMENTS

| | | | | |
|---|---|---|---|---|
| 4,535,583 | A * | 8/1985 | Tanaka et al. | 53/75 |
| 4,608,805 | A * | 9/1986 | Kelly | 53/308 |
| 4,614,077 | A * | 9/1986 | Muto et al. | 53/490 |
| 4,616,466 | A * | 10/1986 | Tanaka et al. | 53/75 |
| 4,765,119 | A * | 8/1988 | Aidlin et al. | 53/308 |
| 5,152,182 | A * | 10/1992 | Searle | 73/862.23 |
| 5,301,488 | A * | 4/1994 | Ruhl et al. | 53/55 |
| 5,321,935 | A * | 6/1994 | Spatz et al. | 53/490 |
| 5,400,564 | A * | 3/1995 | Humphries et al. | 53/75 |
| 5,415,050 | A * | 5/1995 | Trendel et al. | 73/862.23 |
| 5,419,094 | A * | 5/1995 | Vander Bush et al. | 53/75 |
| 6,105,343 | A * | 8/2000 | Grove et al. | 53/490 |
| 2003/0041560 | A1 | 3/2003 | Kemnitz | |

FOREIGN PATENT DOCUMENTS

| | | |
|---|---|---|
| DE | 102 45 879 | 4/2004 |
| EP | 0 639 529 | 2/1995 |
| EP | 1 249 426 | 10/2002 |
| FR | 2 856 394 | 12/2004 |
| JP | 522 9593 | 9/1993 |
| WO | WO 2004/085304 | 10/2004 |

OTHER PUBLICATIONS

International Search Report PCT/EP2007/004538 and English translation thereof.
International Preliminary Report on Patentability PCT/EP2007/004538 and English translation thereof.

* cited by examiner

*Primary Examiner* — Sameh H. Tawfik
(74) *Attorney, Agent, or Firm* — Nils H. Ljungman & Associates

(57) ABSTRACT

Method and apparatus for testing, determining, and adjusting a closing torque of a container closing machine. The method involves at least partially unscrewing a screw cap or closure in the closing machine and measuring an opening torque used to at least partially unscrew said screw cap or closure. The measured opening torque is then compared with a desired range of opening torque and an adjustment of the closing torque for the particular closing device is calculated and performed such that, upon the closing device screwing screw caps or closures on containers in a run of containers, the closed containers are openable using an opening torque within the desired range of opening torque.

6 Claims, 7 Drawing Sheets

METHOD OF TESTING, DETERMINING, AND ADJUSTING A FINAL CLOSING TORQUE OF A BEVERAGE BOTTLE OR CONTAINER CLOSING MACHINE AND AN APPARATUS FOR PERFORMING THE METHOD

CONTINUING APPLICATION DATA

This application is a Continuation-In-Part application of International Patent Application No. PCT/EP2007/004538, filed on May 23, 2007, which claims priority from Federal Republic of Germany Patent Application No. 10 2006 025 811.8, filed on May 31, 2006. International Patent Application No. PCT/EP2007/004538 was pending as of the filing date of this application. The United States was an elected state in International Patent Application No. PCT/EP2007/004538.

BACKGROUND

1. Technical Field

The present application relates to method of testing, determining, and adjusting a final closing torque of a beverage bottle or container closing machine and an apparatus for performing the method.

2. Background Information

Background information is for informational purposes only and does not necessarily admit that subsequently mentioned information and publications are prior art.

Beverages and other liquid products are commonly stored in containers or bottles such as plastic bottles, blow-molded bottles, or polyethylene terephthalate (PET) bottles. Such bottles often have threaded mouth portions onto which a threaded screw cap or closure is placed to close the bottle. These screw caps are usually placed on the bottles by an automated or motorized closing machine located downstream of a filling machine. Especially with plastic bottles, it is desirable to screw the screw caps onto the bottles with sufficient force or torque to close and seal the bottle, but without over tightening the bottle such that the bottle is damaged or is very difficult to open by a consumer.

For containers, for instance, bottles, such as plastic bottles, blow-molded bottles, or polyethylene terephthalate (PET) bottles, that are closed with screw caps, it is desired that the consumer should exert, for opening of a bottle, a certain amount of force, i.e. the maximum opening-torque for the opening of such closures is expended; in other words, such screw caps should not be tightened at the bottle mouth to present an uncomfortable opening of a bottle. However, it is also desired that a screw cap is screwed tightly enough onto the respective container in order so as to effectuate sealing of the bottle by closing of the screw cap on a bottle and, for instance, preclude the escape of contents materials, e.g., carbonic acid, or carbon dioxide when in water, but also to preclude the ingress of foreign matter, to reliably restrict or minimize introduction, for instance, of injurious germs into the container as originally closed during the bottle filling operation.

In other words, some bottles are closed with screw caps or screw closures. To open a bottle with a screw cap, the consumer exerts a force or opening-torque to remove the screw cap. Bottles should be sufficiently closed to restrict or minimize bottle contents from leaking or escaping, while also being sufficiently closed to restrict or minimize dangerous foreign matter from entering the bottles. However, bottles should not be closed so tightly that the consumer exerts an uncomfortable amount of opening force or opening-torque to open the bottle.

On account of the qualities or characteristics of the combination comprising a screw cap and a container, and due to the construction and the control of the motorized units or arrangements for closing of the containers, the desired force, hereinafter also referred to as torque or opening-torque that is desired for a subsequent opening of a container, is determined by the maximum force or torque (herein below also referred to as closing final-torque) upon screwing of a screw cap onto a container, i.e. during closing of the container upon filling.

So as to accommodate the preceding requirements concerning maintenance of operational production assuredness and user-friendliness, it is necessary or desired to set the closing-force desired to properly secure the cap with a corresponding maximum closing final-torque, or force. Furthermore, it is also desirable to hold the corresponding opening-torque of all or most closed containers within narrow tolerance limits, i.e. the force a user should apply to unscrew a cap from a bottle.

Some closing machines empirically set the closing final-torque by use of motorized closing units, namely, for instance, by the fact that in a setting, tuning, or equilibration phase, several containers are closed by the pertaining closing unit that is to be tuned, and such closed containers are again manually opened afterwards. On this occasion, the opening-torque is determined using a suitable measuring instrument (e.g., a torque meter). Then, through a comparison of the set-point value of the opening-torque with the measured actual value of this force or torque, the respective screw unit or closing unit is set as desired, also taking into consideration the measured values of further tuning investigations. It is of possible disadvantage in this method, among other things, that the manual measurements for this setting or tuning may require trained staff capable to utilize the measured parameters or values for conclusions pertaining to the final setting of the respective closing unit. It is disadvantageous, furthermore, that the measuring results that are taken during the course of the tuning or equilibration phase are rather inexact during opening of the containers, namely because of the manual opening movement which basically can not be carried out with a constant movement, or consistently, or, respectively, continuously.

OBJECT OR OBJECTS

A task of the present application is to provide a method with which the balancing or tuning can be fully done by a pertaining closing machine. For the solution of this task, a method is disclosed, pertaining to the determination and/or pertaining to the regulation of the closing final-torque while closing bottles, or such like containers, with threaded closures that can be screwed onto a threaded portion of the container under use of a motorized closing unit of a closing machine. There is effectuated during a tuning, or equilibration phase the re-opening of at least one closure of a prior closed container, and also there is determined, on this occasion, as a correction value, at least the opening-torque necessary for this re-opening, and the subsequent closing of the containers is effectuated by the closing unit with a closing final-torque that takes into operational consideration this correction value. During the tuning, or equilibration phase of the pertaining at least one closure there is effectuated a re-opening of the pertaining closure by the closing unit and there is determined, on this occasion, as a correction value, at least the opening-torque necessary for this re-opening of the closing unit and/or the opening-torque of a drive arrangement of the closing unit. A closing machine with which this method can be carried out is the subject of a closing machine for closing of bottles, or such like containers with closures by a threaded engagement connection configured to permit screwing of a closure onto a container, or screwing-on, with at least one screw, or closing unit comprising a closing head comprising a drive, or drive motor arrangement, configured to effectuate a threaded engagement, or configured for screwing-on of the closures onto the containers, comprising means configured to perform measurement of the torque of the closing unit, or, respectively, of the torque of the closing head.

SUMMARY

The method in accordance with the present application provides the advantage that also the simultaneous or substantially simultaneous balancing or tuning of several screw units or closing units of a closing machine is possible substantially without hitherto desired manpower, and possibly without personnel which hitherto was desired for manually carrying out special measurements pertaining to the tuning operation.

Furthermore, the method in accordance with one aspect of the present application reduces the time requirements to a much shorter time desired for the balancing of the screw units or closing units and, additionally, the method provides reproducible results at a reduction of costs.

Further aspects of the present application are the subject of the dependent claims disclosed according to at least one possible embodiment of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail in the following with reference to drawing figures of embodiment examples. There is shown in.

DESCRIPTION OF EMBODIMENT OR EMBODIMENTS

Figure 1:
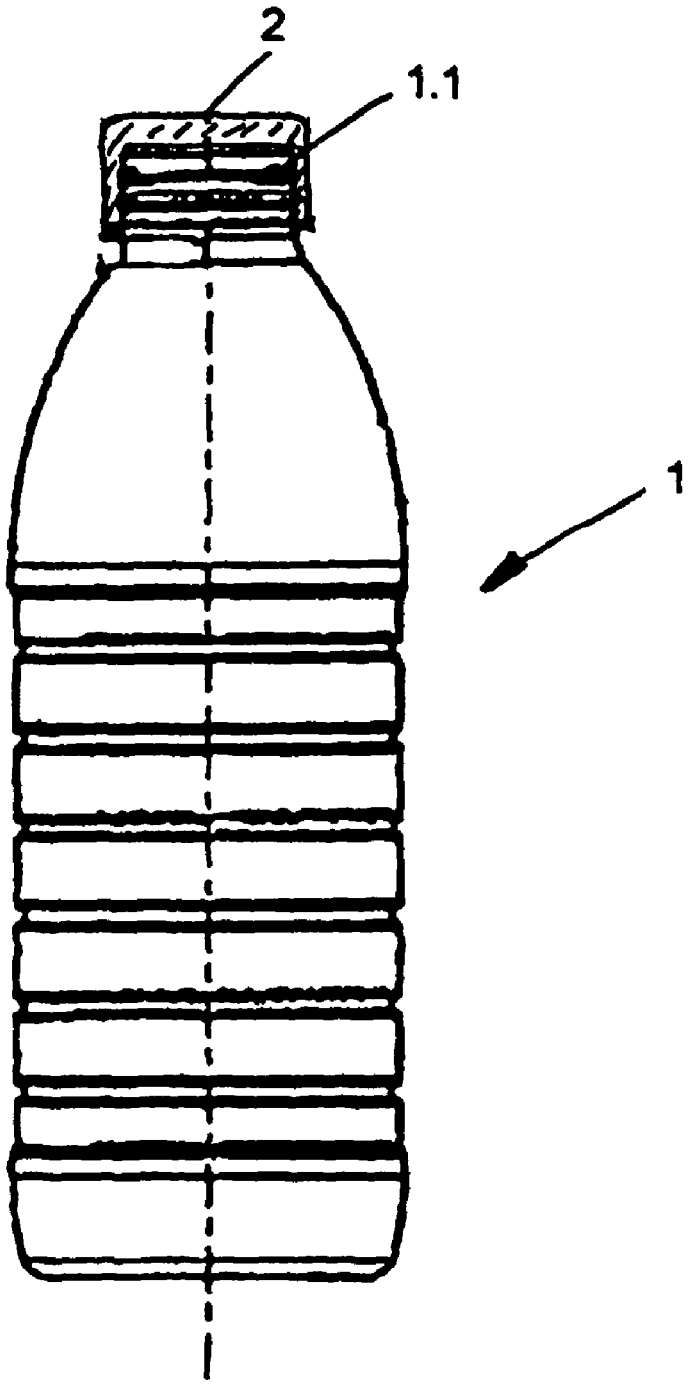
FIG. 1 a bottle closed with a screw cap.
Figure 2:
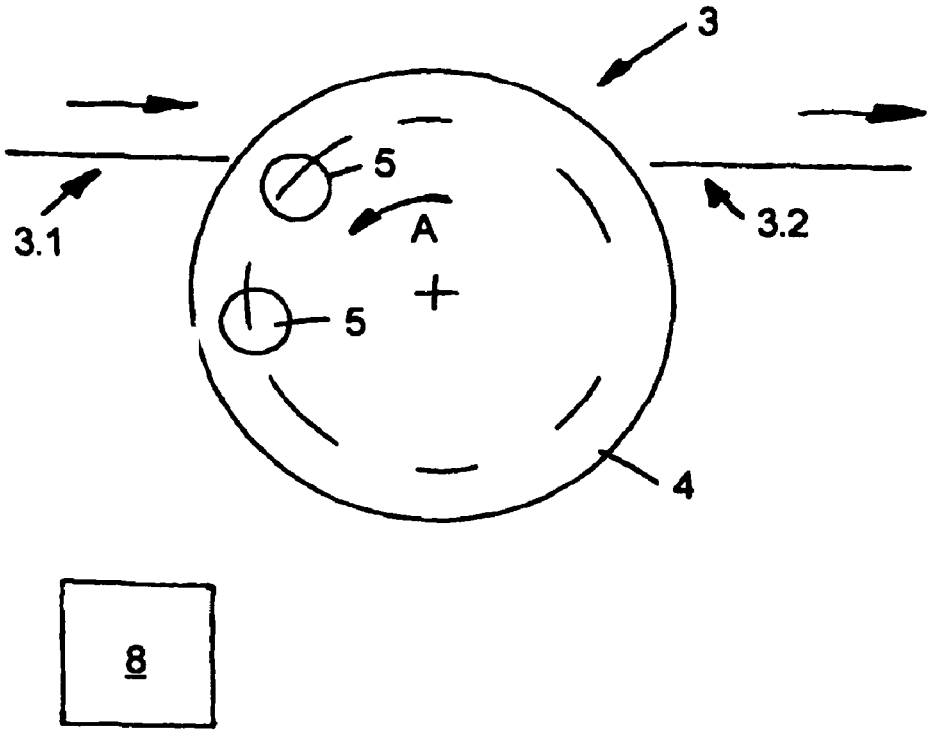
FIG. 2 in simplified illustration and in top plan view a closing machine of the rotary, or carousel type.

In the figures, a container 1 is in the form of a bottle which is closed by a closure 2, the screw cap 2 being shown in cross-section in FIG. 1. Closing of the bottles 2 occurs in the way basically known to the expert in the art, in a closing machine 3, of which in FIG. 2 is shown schematically with a rotor 4 that is configured for rotation in reference to a vertical machine axis, and several closing positions 5 are disposed at the circumference of the rotor 4. The bottles 1 to be closed are supplied in each case to a closing position 5 by way of a bottle inlet arrangement 3.1 of the closing machine 3. The closed bottles 1 are fed from a bottle outlet arrangement 3.2 to other processing stages.

In the region of the angle pertaining to the rotating movement (indicated by the direction of the arrow A) of the rotor 4 between the bottle inlet arrangement 3.1 and the bottle outlet arrangement 3.2, a closure 2 is positioned atop every bottle 1; this closure 2 then is screwed onto the threads 1.1 forming part of the respective bottle mouth, namely with the relevant closing final-torque which causes, among other things, under taking into account different bottle parameters or closure parameters, and the number of the thread turns and the slope or pitch of the threads 1.1, and further taking into account material parameters, etc., an opening-moment or opening-torque that should be applied during unscrewing by the respective user for opening of the bottle 1, or, respectively, while removing the closure 2 and this opening-moment is therefore a function of the closing final-torque.

For securing of the closures 2 on the bottles 1, every closing position 5 comprises, as is likewise known to the expert in the art, a closing unit 6 with an associated screw spindle or closing head 7 with an associated drive or drive arrangement with which (screw spindle, or closing head) the respective closure 2 is screwed onto the threads 1.1 provided at the bottle mouth. Every closing unit 6 is individually controllable, namely for achievement of the closing final-torque during closing that corresponds in each case to a desired opening-torque, as is further explained herein below. The drives that are associated with the individual closing units 6 in one possible embodiment comprise such drives which are configured to permit an individual setting, independent of the other drives in terms of number of revolutions, rotation directions, and/or torques. Thus, such drives may comprise, e.g., known servo-motors, step motors, or synchronous motors for which the desired operating parameters can be given, or set, and realized in controlled and/or regulated manner.

In one embodiment of the method in accordance with the present application, for instance, an individual balancing (tuning) of the individual closing units 6 or their associated drives occurs, namely, in such a way that, while initially taking into account known parameters, for example, such parameters as pertaining to the configuration and/or geometry of the threads 1.1, the configuration and geometry of the closures 2, the types of the materials used in each case, etc., as well as taking into account the desired opening-torque or opening-moment, there is computed the closing final-torque or, respectively, the moment corresponding thereto at the screw, or screw spindle or closing head 7, computing being done, for instance, with the help of a mathematical model which also illustrates, or, respectively, takes into consideration mechanical and/or electromagnetic circumstances of the closing units 6.

Then, with this default-moment or moment-setting, an individual balancing of the closing units 6 occurs at every closing position 5, namely such that by way of this tuning a bottle 1 is closed, and is opened afterwards again, using this computed default-moment, or, respectively this calculated moment. The arising moments, number of revolutions, and angles of rotation are gathered using a suitable sensor, or recording arrangement, or, respectively are stored for the subsequent computations and optimizations.

Figure 3:
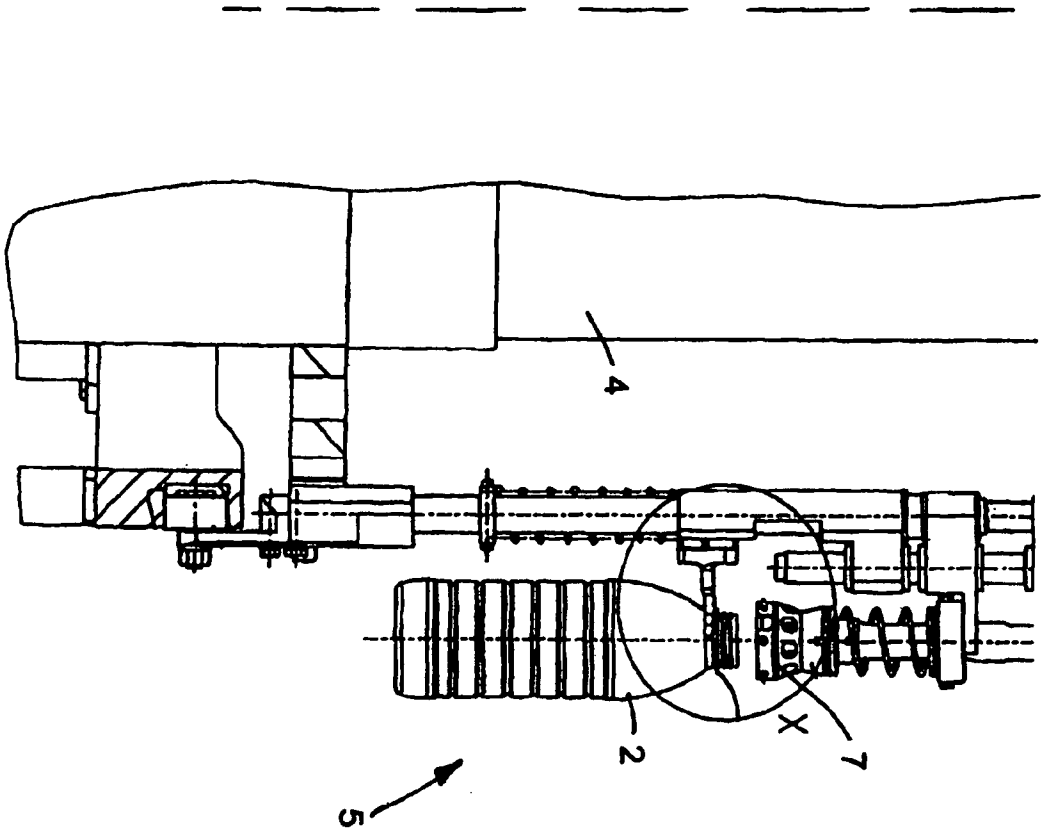
FIG. 3 a screw unit or closing unit of the closing machine in accordance with the embodiment of FIG. 2, with a screw spindle and its associated drive, or drive arrangement.
Figure 3A:
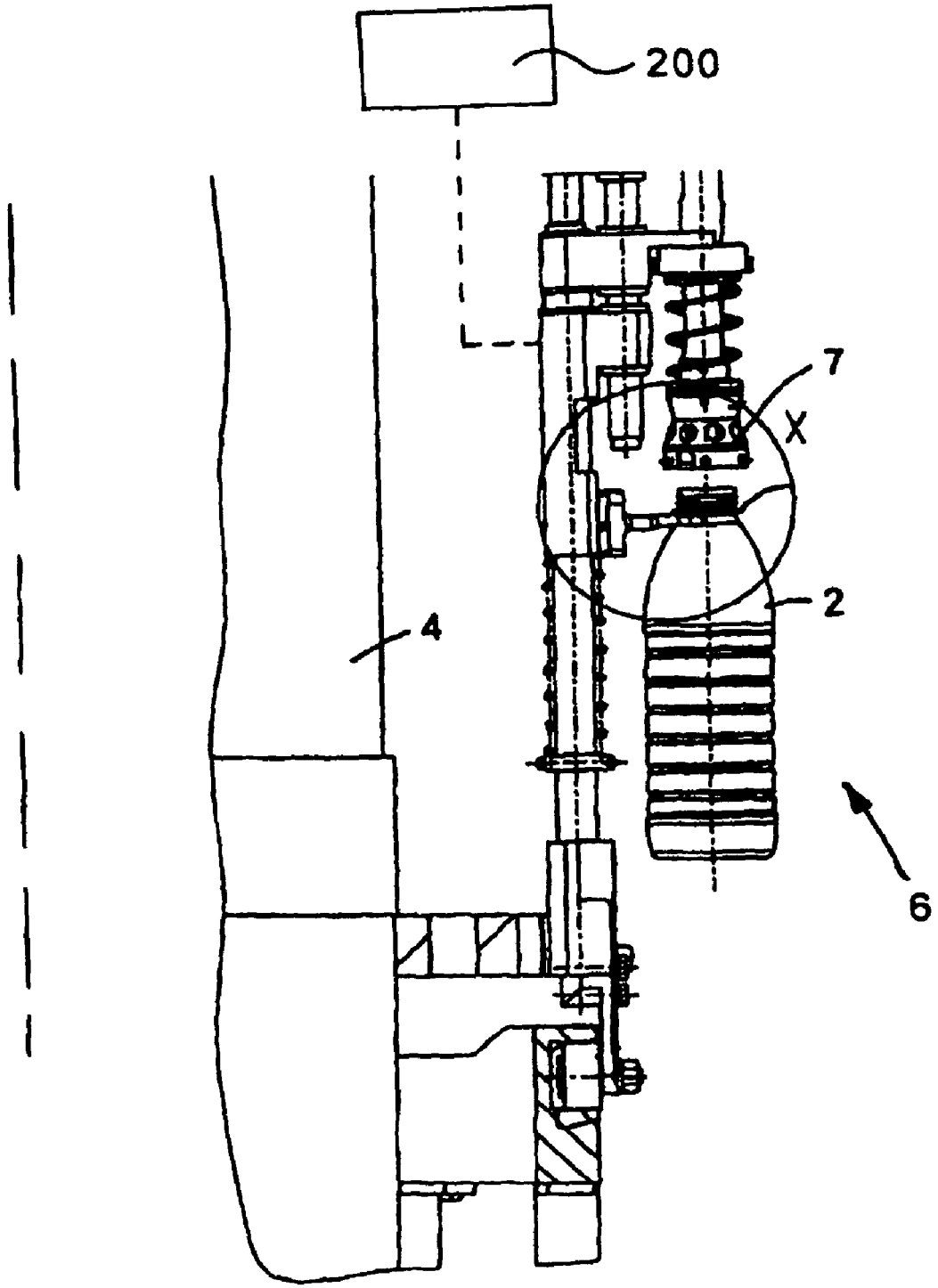
FIG. 3A shows a torque and/or electric current measuring arrangement operatively connected to a screw unit or closing unit shown in FIG. 3, according to at least one possible embodiment.
Figure 4:
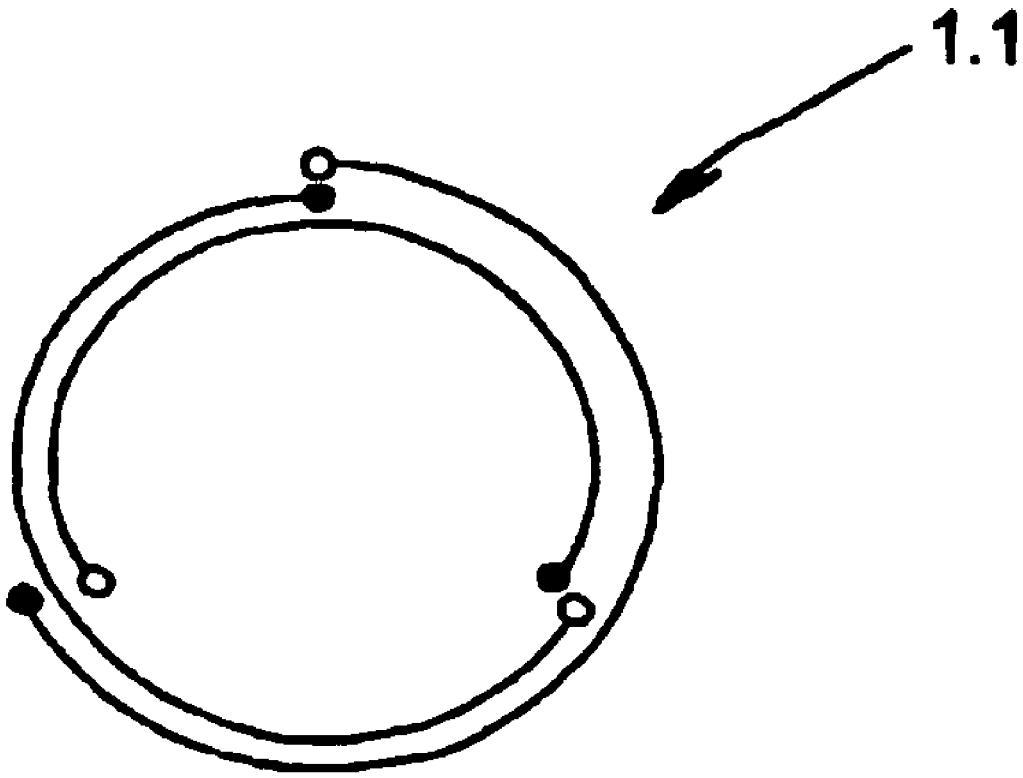
FIG. 4 a schematic representation of threading comprising a triple-threaded configuration, or arrangement intended for a screw cap with two-third threading, or windings.

In one possible embodiment of the present application, the measurement of the moments can occur through utilization of suitable devices, for instance, torque boxes, expansion measuring strips, or strain gauges, but also indirectly by way of measuring of the current of the motor of the drive arrangement of the respective closing unit 6. Basically it can be enough to gather in each case the maximum value of the torques, the number of revolutions, and/or the angle of rotation and to store the pertaining data accordingly. FIG. 3A shows a torque and/or electric current measuring arrangement 200 operatively connected to the closing unit 6.

During the determination of the torques by way of measurement of the current of the motor there are determined, for instance, the maximum value of the current at the termination of the closing step (as a measuring value of the closing final-torque), as well as also the maximum value of the current while carrying out the respective opening (as a measuring value of the opening-moment). Furthermore, there is determined the opening speed in terms of number of revolutions. Then, with the aid of a current torque-identity-line that is specific for the pertaining motor and taking into account the pertaining gear arrangement, or gear setting one can compute with adequate exactness the torque that is applied by the closing unit 6 or, respectively, its screw spindle, or closing head 7 at the closure 2 while closing and opening a pertaining container 1.

Then, for instance, individually for every closing unit 6 the original closing final-torque that was determined with the aid of the computational model, or empirically, is corrected on the basis of the measured value, or values that were obtained during the balancing, or tuning phase during opening, in one possible embodiment with the aid of the ascertained opening-torque in such a way that the opening-torque or opening-moment that is the result of the closing final-torque corresponds to the desired value. This correction occurs, for instance, through multiplication of the originally computed or empirically fixed closing final-torque by a correction factor which corresponds to the quotient derived from the set value for the opening-torque or opening-moment and the ascertained actual value of the opening-moment determined during the balancing or tuning phase.

Upon the balancing or tuning of all or most closing units 6 at the closing positions 5, i.e. after conclusion of the tuning or equilibration phase, closing of the bottles 1 with the closures 2 occurs in a succeeding production phase through engagement of the pertaining threads of a bottle 1 and the pertaining cap 2, or screwing, in such a way that for every bottle 2 there arises an opening-torque of the desired magnitude.

On this occasion, there exists in one possible embodiment of the present application the possibility to carry out the adaptation of the individual closing units 6 in such a way that the original closing final-torque for the closing elements or units 6 of all or most closing positions 5 are filed as a common value in a control unit 8 and, also there is filed or stored individually for every closing unit 6, the correction factor, or, respectively the tuning factor.

In the case of electrical drives that exhibit an operational behavior that is similar or alike to direct current machines or drives, the current-torque-identity-line is also dependent on the number of revolutions, such that during the regulation of the torque, in one possible embodiment also of the maximum opening-torque or opening-moment the number or revolutions of the respective closing unit or arrangement 6, or, respectively, of the head 7 is taken into consideration.

Furthermore, the torque is also dependent upon the respective installation situation and the specific mechanical circumstances of each closing unit 6, so that it is at least sensible for enhancing of the balancing, through measurement of the current that is at hand during idling, to determine the idling-torque of each closing unit 6 and to effectuate a corresponding data storage in the memory arrangement of the control equipment 8, namely, individually for each closing unit 6, so that this idling-torque can be taken into consideration during the determination of the correction or tuning factor of each closing unit and/or, however, later in the production phase while closing the bottles 1 with the corrected commencement-value of the closing final-torque, in addition to the respective correction factor.

It is desired for the determination of the tuning factor to loosen the respective closure 2 at the relevant bottle 1 and this can be sufficiently accomplished by a turning movement through a small angle, for instance, an angle of ninety degrees. Through lowering of the velocity in terms of the number of revolutions of the rotor 4 of the closing machine 3 during the determination of the tuning factor, it becomes possible to close the relevant bottle 2 again during its further progress through the closing machine 3 after the prior opening, so that rejects possibly arising during the balancing phase are substantially restricted or minimized.

With the described balancing, or, respectively, with the described determination of the correction factor, furthermore, measuring values can also be taken into consideration which were manually determined outside of the closing machine, for instance, through measurement of the opening-torque. Furthermore, by way of comparisons of different opening methods, namely, for instance, the opening by the respective closing unit 6 and by the manual opening outside of the closing machine 3, additional or further factors or findings can also be determined which can be used for the balancing, or, respectively, for the determination of the correction factor or tuning factor.

The angle pertaining to the fastening of the respective closure 2 onto a bottle 1 up to the point of final closing is influenced quite decisively by the geometry of the closure 2, or, respectively, the threads, or threading 1.1. The following example of a triple-threaded closure with two-third threading or winding that is shown in a plan view makes this clear.

When the number of the thread flights or turns is identified by the expression $N_G$, and the number of the windings or turns of the threading is identified by the expression $N_W$, then the thread division or ratio as identified by the letter T corresponds to the angle between two thread beginnings succeeding one another and is calculated from the ratio of the full angle to the number of the thread turns or windings:

$$T=2\pi/N_G$$

The maximum angle pertaining to the threaded connection, or angular measurement value or magnitude corresponds to the number of windings or turns in radians (rad):

$$\phi_{V,max}=2\pi\cdot N_W$$

The minimum angle pertaining to the threaded connection or angular measurement value or magnitude is smaller by a division than the maximum angle pertaining to the threaded connection or angular measurement value or magnitude:

$$\phi_{V,min}=2\pi\cdot N_W T=2\pi[N_W-1/N_G]$$

The following example of a triple-threaded closure with two-third threading or winding that is shown in a plan view makes this clear. For a better representation the superposed thread turns were drawn into each other, and the white point corresponds to the beginning of the threading and the black point corresponds to the end of the threading.

One can now visualize the closing by way of the pertaining intermeshing of threads or screwing in such a way that an imaginary point of the bottle threading can be located at any arbitrary or random position or location of the respective outermost lines. By way of turning, in the mathematically negative direction, there is effectuated a screw-down, or closing of the bottle. If the imaginary bottle thread point reaches the final position shown in black in the drawing, there arises tensioning, or stressing, or possibly over-tensioning of the connection between the closure and the bottle.

Figure 5:
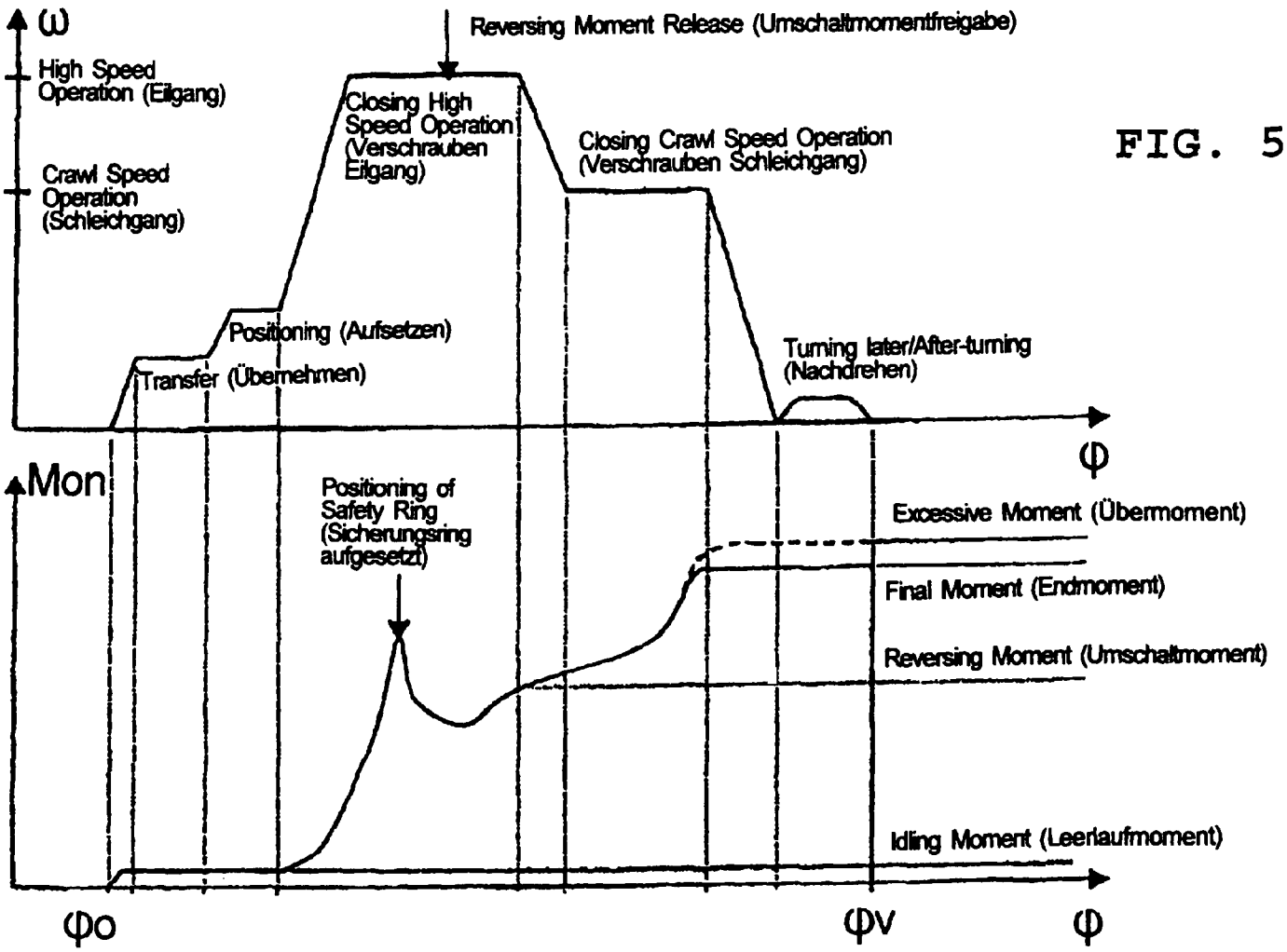
FIG. 5 diagrams indicative of the angular velocity, as well as the torque conditions upon closing of a bottle, as a function of the degree of the turning angle, or, respectively, the threading angle.

FIG. 5 illustrates in diagrams "a," or, respectively "b," the typical course of the angular velocity of the respective closing unit 6, or, respectively, the head 7 and of the torque transferred to a closure 2 while closing a bottle 1 with the closure 2 during the production phase.

As is shown in the diagram, initially during the condition of a rather constant rotational velocity, or angular velocity of omega (ω), there is effectuated the receipt of the respective closure 2 by a closing unit 6 and then follows the positioning of the closure 2 onto the respective bottle 1. Then thread engagement occurs under the condition of a raised angular velocity of omega (ω), and the torque also increases under conditions of the increase of the angle phi (ϕ) pertaining to the threading, as is generally depicted in diagram "b." As soon as a level of reversing-torque is reached, the rotational velocity or speed omega (ω) of the closing unit 6 is reduced so that, upon reaching of a closing final-torque, there arises the reduction to the value of zero, namely under the condition of maintaining of the closing final-torque, so that there can still be effectuated a further screwing or turning of the closure 2 during an adaptation of the thread flights; finally the closure 2 is secured or screwed onto the bottle 1, or, respectively, the threaded portion 1.1 at the bottle mouth under the conditions of a closing final-torque that corresponds to the desired opening-torque.

The present application was described herein above on the basis of one embodiment. It will be appreciated that numerous changes as well as variations are possible, without departing from the underlying thought and scope of the present application.

Thus, in the preceding disclosure as a starting point there was disclosed that the balancing, or, respectively, the tuning is done prior to a subsequent production phase. Basically, the present application comprises, further, the possibility to carry out this balancing, for instance, continuously, or in each case during predetermined time intervals during a production phase. Such periodical balancing during a production phase has the advantage that when the balancing is done during the production phase, incoming changes of the operating parameters are readily taken into consideration, for instance, changes attributable to conditions of wear, arising, in one possible embodiment, at the screw and closing units 6, or their heads 7 and through this there is attained an optimal production-rate.

In a method for the control of the closing final-torque during closing of bottles, or such like containers with closures that can be secured by screwing, under use of a motorized closing unit of a closing machine at least one closure of a prior closed container is re-opened, or unscrewed again in a tuning, or equilibration phase. On this occasion, at least the opening-moment desired for this re-opening is determined as a correction value and the next closing of the containers by the closing final-torque is effectuated by the closing unit under utilization of the correction value.

Figure 6:
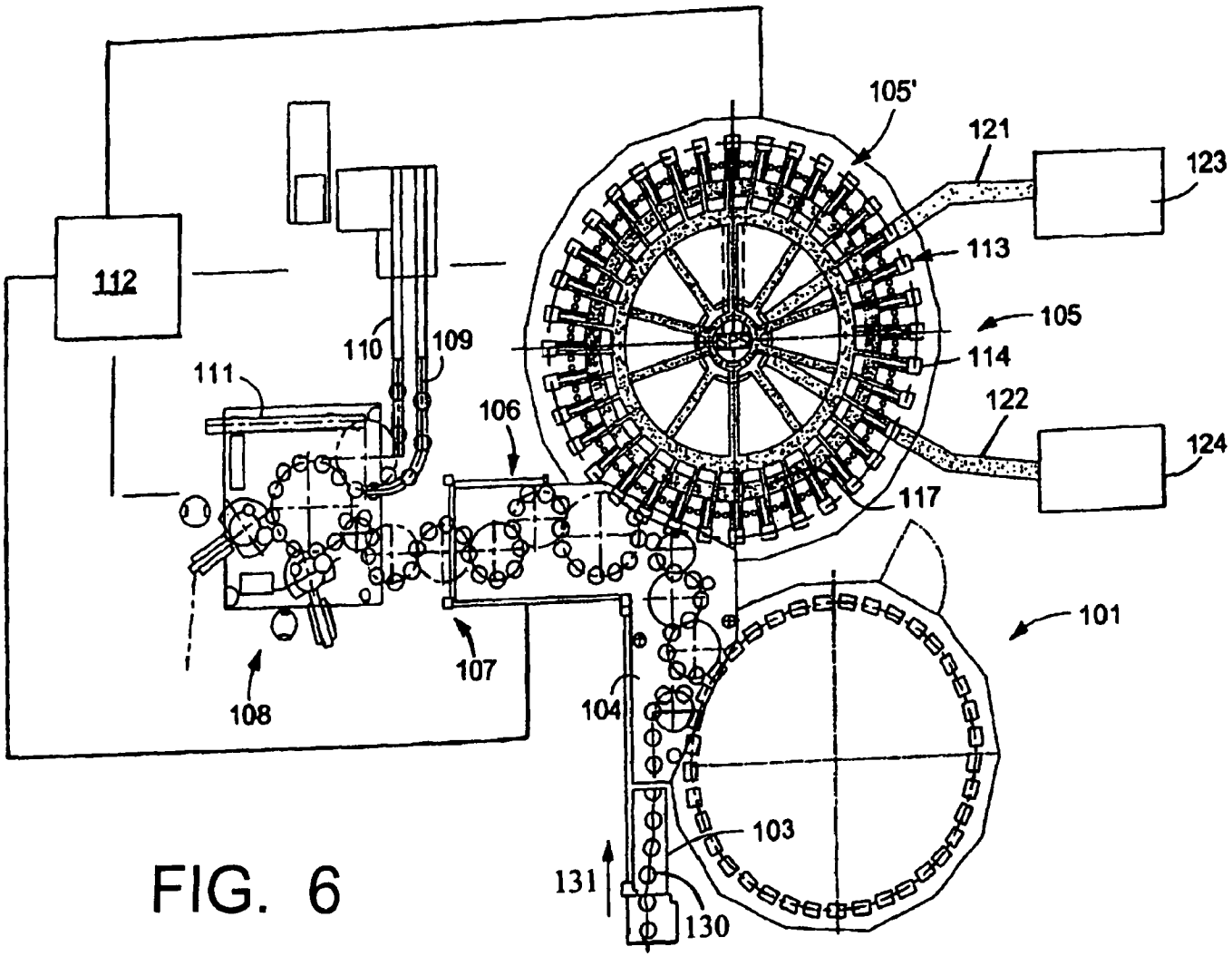
FIG. 6 shows schematically the main components of one possible embodiment example of a system for filling containers, specifically, a beverage bottling plant for filling bottles with at least one liquid beverage, in accordance with at least one possible embodiment.

FIG. 6 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 6 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 6, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time if the filing of this patent application to possibly reside broadly in a method pertaining to the determination and/or pertaining to the regulation of the closing final-torque while closing bottles, or such like containers, with threaded closures 2 that can be screwed onto a threaded portion of the container 2 under use of a motorized closing unit 6 of a closing machine 3 in which method there is effectuated during a tuning, or equilibration phase the re-opening of at least one closure 2 of a prior closed container 1, and also in which method there is determined, on this occasion, as a correction value, at least the opening-torque desired for this re-opening, and the subsequent closing of the containers 1 is effectuated by the closing unit 6 with a closing final-torque that takes into operational consideration this correction value, wherein that during the tuning, or equilibration phase of the pertaining at least one closure 2 there is effectuated a re-opening of the pertaining closure 2 by the closing unit 6 and there is determined, on this occasion, as a correction value, at least the opening-torque desired for this re-opening of the closing unit 6 and/or the opening-torque of a drive arrangement of the closing unit 6.

Another feature or aspect of an embodiment is believed at the time if the filing of this patent application to possibly reside broadly in the method, wherein that at the beginning of the tuning, or equilibration phase there is determined the idling-moment of the at least one closing unit 6.

Yet another feature or aspect of an embodiment is believed at the time if the filing of this patent application to possibly reside broadly in the method, wherein that the idling-moment is taken into consideration for the determination of the corrected closing final-torque.

Still another feature or aspect of an embodiment is believed at the time if the filing of this patent application to possibly reside broadly in the method, wherein that the idling-moment is taken into consideration during the determination of the opening-moment during the tuning, or equilibration phase.

A further feature or aspect of an embodiment is believed at the time if the filing of this patent application to possibly reside broadly in the method, wherein that from the measurement values obtained while re-opening the at least one container 1 during the tuning, or equilibration phase a correction factor is established by means of which is corrected one of: an original closing final-torque, and empirically determined closing final-torque, or a computed closing final-torque.

Another feature or aspect of an embodiment is believed at the time if the filing of this patent application to possibly reside broadly in the method, wherein that by use of a closing machine 3 comprising at least two closing units 5 the balancing is done individually for each closing unit.

Yet another feature or aspect of an embodiment is believed at the time if the filing of this patent application to possibly reside broadly in the method, wherein that individually for every closing unit the pertaining idling-moment and/or the correction factor are determined individually and/or are stored.

Still another feature or aspect of an embodiment is believed at the time if the filing of this patent application to possibly reside broadly in the method, wherein that a tuning, or equilibration phase is succeeded in each case by a production phase in which the containers 1 are closed under utilization of the corrected closing final-torque.

A further feature or aspect of an embodiment is believed at the time if the filing of this patent application to possibly reside broadly in the method, wherein that during the production phase there is effectuated continuously, or in given intervals in each case a balancing.

Another feature or aspect of an embodiment is believed at the time if the filing of this patent application to possibly reside broadly in the method, wherein that the corrected closing final-torque is derived by the multiplication of the value corresponding to the starting closing final-torque by the correction factor.

Yet another feature or aspect of an embodiment is believed at the time if the filing of this patent application to possibly reside broadly in the method, wherein that the correction factor is derived as a quotient from a desired value of the opening-moment and the value of the opening-moment measured during the tuning phase.

One feature or aspect of an embodiment is believed at the time if the filing of this patent application to possibly reside broadly in a closing machine for closing of bottles, or such like containers 1 with closures 2 by a threaded engagement connection configured to permit screwing of a closure onto a container 1, or screwing-on, with at least one screw, or closing unit 6 comprising a closing head 7 comprising a drive, or drive motor arrangement, configured to effectuate a threaded engagement, or configured for screwing-on of the closures 2 onto the containers 1, comprising means configured to perform measurement of the torque of the closing unit 6, or, respectively, of the torque of the closing head 7.

Another feature or aspect of an embodiment is believed at the time if the filing of this patent application to possibly reside broadly in the closing machine, wherein that the means configured to perform the measurement of the torque comprises an arrangement configured to measure the current of a drive motor.

Still another feature or aspect of an embodiment is believed at the time if the filing of this patent application to possibly reside broadly in the closing machine, wherein that for the determination of the torque of the at least one closing unit 6, or, respectively the torque of the closing head 7 there is provided a sensor arrangement configured to substantially directly measure the pertaining torque.

A further feature or aspect of an embodiment is believed at the time if the filing of this patent application to possibly reside broadly in the closing machine, comprising at least two closing units 6 with respectively one closing head 7, as well as with means configured to individually measure the torques of each closing unit 6, or, respectively, the torques of every closing head 7.

Another feature or aspect of an embodiment is believed at the time if the filing of this patent application to possibly reside broadly in a method of testing, determining, and adjusting a final closing torque of a beverage bottle closing machine using a predetermined percentage sample of a run of blow-molded beverage bottles, and subsequent thereto filling and closing the run of blow-molded beverage bottles, said method comprising the steps of: moving a predetermined percentage of empty beverage bottles into a beverage bottle filling machine; filling the predetermined percentage of empty beverage bottles with a liquid beverage; moving the predetermined percentage of filled beverage bottles out of said beverage bottle filling machine and into a beverage bottle closing machine; closing the predetermined percentage of filled beverage bottles by screwing a screw cap or closure using corresponding closing devices of said closing machine onto a threaded mouth portion of each of the predetermined percentage of filled beverage bottles until a final closing torque is achieved; at least partially unscrewing the screw caps or closures using said closing devices of said closing machine, and substantially simultaneously measuring with a measuring arrangement the opening torque used to at least partially unscrew the screw caps or closures; comparing the measured opening torque for each of said closing devices with a desired range of opening torque and calculating an adjustment of the final closing torque for each of said closing devices such that, upon said closing devices screwing screw caps or closures on beverage bottles in the run of beverage bottles using the adjusted final closing torque, the closed beverage bottles are openable using an opening torque within the desired range of opening torque; adjusting the final closing torque of each of said closing devices to the corrected final closing torque; and filling and closing additional beverage bottles in the run of beverage bottles using the corrected final closing torque to produce closed beverage bottles which are openable using an opening torque within the desired range of opening torque.

Yet another feature or aspect of an embodiment is believed at the time if the filing of this patent application to possibly reside broadly in a method of testing, determining, and adjusting a closing torque of a container closing machine using a sample of a run of containers, and subsequent thereto filling and closing the run of containers, said method comprising the steps of: moving a sample of empty containers into a container filling machine; filling the sample of empty containers; moving the sample of filled containers out of said container filling machine and into a container closing machine; closing the sample of filled containers by screwing a screw cap or closure using at least one closing device of said closing machine onto a threaded mouth portion of each of the sample of filled containers until a closing torque is achieved; at least partially unscrewing the screw caps or closures using said at least one closing device of said closing machine, and measuring with a measuring arrangement the opening torque used to at least partially unscrew the screw caps or closures; comparing the measured opening torque from said at least one closing device with a desired range of opening torque and calculating an adjustment of the closing torque for said at least one closing device such that, upon said at least one closing device screwing screw caps or closures on containers in the run of containers using the adjusted closing torque, the closed containers are openable using an opening torque within the desired range of opening torque; adjusting the closing torque of said at least one closing device to the corrected closing torque; and filling and closing additional containers in the run of containers using the corrected closing torque to produce closed containers which are openable using an opening torque within the desired range of opening torque.

Still another feature or aspect of an embodiment is believed at the time if the filing of this patent application to possibly reside broadly in a machine for performing the method, said machine is configured to test, determine, and adjust a closing torque of a container closing machine using a sample of a run of containers, and subsequent thereto filling and closing the run of containers, said machine further comprises: an apparatus configured to move a sample of empty containers into a container filling machine; a container filling machine configured to fill the sample of empty containers; an apparatus configured to move the sample of filled containers out of said container filling machine and into a container closing machine; a container closing machine comprising at least one closing device configured to close the sample of filled containers by screwing a screw cap or closure onto a threaded mouth portion of each of the sample of filled containers until a closing torque is achieved, and to at least partially unscrew the screw caps or closures; a measuring arrangement configured to measure the opening torque used to at least partially unscrew the screw caps or closures, and to compare the measured opening torque from said at least one closing device with a desired range of opening torque and calculate an adjustment of the closing torque for said at least one closing device such that, upon said at least one closing device screwing screw caps or closures on containers in the run of containers using the adjusted closing torque, the closed containers are openable using an opening torque within the desired range of opening torque, and to adjust the closing torque of said at least one closing device to the corrected closing torque; and said at least one closing device is configured to fill and close additional containers in the run of containers using the corrected closing torque to produce closed containers which are openable using an opening torque within the desired range of opening torque.

A further feature or aspect of an embodiment is believed at the time if the filing of this patent application to possibly reside broadly in a closing machine for testing, determining, and adjusting a closing torque of a container closing machine using a sample of a run of containers, and subsequent thereto filling and closing the run of containers, said closing machine comprising: means for closing a sample of filled containers by screwing a screw cap or closure onto a threaded mouth portion of each of the sample of filled containers until a closing torque is achieved, and for at least partially unscrewing the screw caps or closures; means for measuring the opening torque used to at least partially unscrew the screw caps or closures; means for comparing the measured opening torque with a desired range of opening torque and calculating an adjustment of the closing torque such that, upon said closing means screwing screw caps or closures on containers in the run of containers using the adjusted closing torque, the closed containers are openable using an opening torque within the desired range of opening torque; means for adjusting the closing torque to the corrected closing torque; and said means for closing a sample of filled containers also comprising means for closing additional containers in the run of containers using the corrected closing torque to produce closed containers which are openable using an opening torque within the desired range of opening torque.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Oct. 24, 2007, and/or cited elsewhere are hereby incorporated by reference as if set forth in their entirety herein as follows: WO 2004/085304, having the title "A METHOD AND A DEVICE FOR CONTROLLED CLOSING OF CONTAINERS WITH THREADED CAPS," published on Oct. 7, 2004; FR 2 856 394, having the following English translation of the French title "CONTAINER CAPPING CONTROL DEVICE AND METHOD AND ASSOCIATED MACHINE," published on Dec. 24, 2004; EP 1 249 426, having the title "CAPPING METHOD AND CAPPING APPARATUS," published on Oct. 16, 2002; US 2003/041560, having the title "ROTARY CAPPING APPARATUS AND FEEDBACK CONTROL SYSTEM FOR REGULATING APPLIED TORQUE," published on Mar. 6, 2003; and EP 0639529, having the following English translation of the German title "DEVICE AND METHOD FOR SCREWING SCREWCLOSURES," published on Feb. 22, 1995.

The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

All of the patents, patent applications or patent publications, which were cited in the German Office Action dated Jun. 2, 2006, and/or cited elsewhere are hereby incorporated by reference as if set forth in their entirety herein as follows: JP 5229593, having the following English translation of the Japanese title "CAPPER EQUIPPED WITH DEVICE FOR DETECTING UNCAPPING TORQUE," published on Sep. 7, 1993; and DE 102 45 879, having the following English translation of the German title "DEVICE USED FOR APPLYING SCREW-TYPE CAP TO VESSELS USED IN PHARMACEUTICAL AND CHEMICAL INDUSTRIES HAS SCREW UNIT FORMED AS SERVO-DRIVE COMPRISING SERVO MOTOR AND CONTROL AND/OR REGULATING UNIT," published on Apr. 8, 2004. In addition, U.S. application Ser. No. 12/235,895, filed Sep. 23, 2008, entitled "TRANSPORT SYSTEM FOR BOTTLES OR SIMILAR CONTAINERS AND PLANT FOR THE TREATMENT OF BOTTLES OR SIMILAR CONTAINERS" incorporated by reference as if set forth in its entirety herein.

The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 025 811.8, filed on May 31, 2006, having inventors Enrico SCHULZ and Karl LORENZ, and DE-OS 10 2006 025 811.8 and DE-PS 10 2006 025 811.8, and International Application No. PCT/EP2007/004538, filed on May 23, 2007, having WIPO Publication No. WO 2007/137737 inventors Enrico SCHULZ and Karl LORENZ, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/004538 and German Patent Application 10 2006 025 811.8 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/004538 and DE 10 2006 025 811.8 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

| | |
|---|---|
| 1 | Bottle |
| 1.1 | Threaded portion, or thread flights at the mouth of the bottle |
| 2 | Cap, cap-like closure |
| 3 | Closing machine, closer |
| 3.1 | Inlet arrangement of 3 |
| 3.2 | Outlet arrangement of 3 |
| 4 | Rotor |
| 5 | Closing position |
| 6 | Closing element, unit, or arrangement with a screw spindle |
| 7 | Drive arrangement for the closing unit |
| 8 | Control unit |

What is claimed is:

1. A method of testing, determining, and adjusting a closing torque of a container closing machine, wherein said container closing machine comprises a plurality of closing devices, each comprising an electric motor, said method comprising the steps of:

(A) moving a first container into said container closing machine;

(B) closing said first container by screwing a screw cap or closure using a closing device of said closing machine onto a threaded mouth portion of said first container until a predetermined first closing torque is achieved;

(C) at least partially unscrewing said screw cap or closure using said closing device of said closing machine, and measuring with a measuring arrangement an opening torque used to at least partially unscrew said screw cap or closure;

(D) comparing said measured opening torque from said closing device with a desired range of opening torque and calculating an adjustment of said first closing torque for said closing device to lie within a desired range of closing torque such that, upon said closing device screwing screw caps or closures on containers in a run of containers using a closing torque within said desired range of closing torque, said closed containers are openable using an opening torque within said desired range of opening torque;

(E) adjusting said first closing torque of said closing device to a closing torque within said desired range of closing torque;

repeating steps (A) through (E) for at least one other closing device;

filling and closing containers using said adjusted closing torque to produce closed containers which are openable using an opening torque within said desired range of opening torque;

continuously monitoring the closing torque of each of said closing devices during closing of containers by:

measuring electric current of each said electric motor of each said closing device upon said closing device generating a closing torque within said desired range of closing torque; and measuring electric current of each said electric motor of each said closing device upon each said electric motor of each said closing device being in an idle state wherein said closing device is not screwing a screw cap or closure onto a container;

upon detecting the closing torque for at least one closing device being outside said desired range of closing torque or being different from said adjusted closing torque, determining an individual correction of closing torque for each said closing device by:

comparing the electric current of said electric motor of each said closing device at said idle state with the electric current of each said electric motor of each said closing device upon generation of a closing torque within said desired range of closing torque; and determining an amount of current, to be supplied to each said electric motor of each said closing device, to generate current sufficient to produce a closing torque within said desired range of closing torque;

adjusting closing torque for each said closing device with said correction for each said closing device;

from the measurement values obtained while unscrewing said container during said adjustment step a correction factor is established by means of which is corrected one of: an original closing torque, an empirically determined closing torque, or a computed closing torque;

individually for each closing device the correction factor is determined individually and/or is stored; and at least one of:

said adjusted closing torque is derived by the multiplication of the value corresponding to said first closing torque by a correction factor; and said correction factor is derived as a quotient from a desired value of said opening torque and the value of said opening torque measured during said adjustment step.

2. An arrangement for performing the method according to claim 1, said arrangement comprises:

a container closing machine comprising a closing device configured to close a container by screwing a screw cap or closure onto a threaded mouth portion of a container until a predetermined first closing torque is achieved, and configured to at least partially unscrew the screw cap or closure;

a measuring arrangement configured to measure the opening torque used to at least partially unscrew the screw cap or closure, and to compare the measured opening torque from said closing device with a desired range of opening torque and calculate an adjustment of the first closing torque for said closing device to lie within a desired range of closing torque such that, upon said closing device screwing screw caps or closures on containers in a run of containers using the adjusted closing torque, the closed containers are openable using an opening torque within the desired range of opening torque;

said measuring arrangement being further configured to adjust the closing torque of said closing device to a closing torque within the desired range of closing torque;

said measuring arrangement being further configured to:

detect electric current of each said electric motor of each said closing device upon said closing device generating a closing torque within said desired range of closing torque;

detect electric current of each said electric motor of each said closing device upon each said electric motor of each said closing device being in an idle state wherein said closing device is not screwing a screw cap or closure onto a container;

compare the electric current of each said electric motor of each said closing device at said idle state with the electric current of each said electric motor of each said closing device upon generation of a closing torque within said desired range of closing torque; and determine an amount of current, to be supplied to each said electric motor of each said closing device, to generate current sufficient to produce a closing torque within said desired range of closing torque;

a container filling machine configured to fill containers with a material; and said closing device is configured to close filled containers in a run of containers using the adjusted closing torque to produce closed containers which are openable using an opening torque within the desired range of opening torque.

3. A method of testing, determining, and adjusting a closing torque of a container closing machine, wherein said container closing machine comprises a plurality of closing devices, each comprising an electric motor, said method comprising the steps of:

(A) moving a first container into said container closing machine;

(B) closing said first container by screwing a screw cap or closure using a closing device of said closing machine onto a threaded mouth portion of said first container until a predetermined first closing torque is achieved;

(C) at least partially unscrewing said screw cap or closure using said closing device of said closing machine, and measuring with a measuring arrangement an opening torque used to at least partially unscrew said screw cap or closure;

(D) comparing said measured opening torque from said closing device with a desired range of opening torque and calculating an adjustment of said first closing torque for said closing device to lie within a desired range of closing torque such that, upon said closing device screwing screw caps or closures on containers in a run of containers using a closing torque within said desired range of closing torque, said closed containers are openable using an opening torque within said desired range of opening torque;

(E) adjusting said first closing torque of said closing device to a closing torque within said desired range of closing torque;

repeating steps (A) through (E) for at least one other closing device;

filling and closing containers using said adjusted closing torque to produce closed containers which are openable using an opening torque within said desired range of opening torque;

monitoring the closing torque of each of said closing devices at intervals during closing of containers by:

measuring electric current of each said electric motor of each said closing device upon said closing device generating a closing torque within said desired range of closing torque; and measuring electric current of each said electric motor of each said closing device upon each said electric motor of each said closing device being in an idle state wherein said closing device is not screwing a screw cap or closure onto a container;

upon detecting the closing torque for at least one closing device being outside said desired range of closing torque or being different from said adjusted closing torque, determining an individual correction of closing torque for each said closing device by:

comparing the electric current of said electric motor of each said closing device at said idle state with the electric current of each said electric motor of each said closing device upon generation of a closing torque within said desired range of closing torque; and determining an amount of current, to be supplied to each said electric motor of each said closing device, to generate current sufficient to produce a closing torque within said desired range of closing torque; and adjusting the closing torque of said at least one closing device to said adjusted closing torque.

4. The method according to claim 3, wherein:

from the measurement values obtained while unscrewing said container during said adjustment step a correction factor is established by means of which is corrected one of: an original closing torque, an empirically determined closing torque, or a computed closing torque;

individually for each closing device the correction factor is determined individually and/or is stored; and at least one of:

said adjusted closing torque is derived by the multiplication of the value corresponding to said first closing torque by a correction factor; and said correction factor is derived as a quotient from a desired value of said opening torque and the value of said opening torque measured during said adjustment step.

5. An arrangement for performing the method according to claim 4, said arrangement comprises:

a container closing machine comprising a closing device configured to close a container by screwing a screw cap or closure onto a threaded mouth portion of a container until a predetermined first closing torque is achieved, and configured to at least partially unscrew the screw cap or closure;

a measuring arrangement configured to measure the opening torque used to at least partially unscrew the screw cap or closure, and to compare the measured opening torque from said closing device with a desired range of opening torque and calculate an adjustment of the first closing torque for said closing device to lie within a desired range of closing torque such that, upon said closing device screwing screw caps or closures on containers in a run of containers using the adjusted closing torque, the closed containers are openable using an opening torque within the desired range of opening torque;

said measuring arrangement being further configured to adjust the closing torque of said closing device to a closing torque within the desired range of closing torque;

said measuring arrangement being further configured to:

detect electric current of each said electric motor of each said closing device upon said closing device generating a closing torque within said desired range of closing torque;

detect electric current of each said electric motor of each said closing device upon each said electric motor of each said closing device being in an idle state wherein said closing device is not screwing a screw cap or closure onto a container;

compare the electric current of each said electric motor of each said closing device at said idle state with the electric current of each said electric motor of each said closing device upon generation of a closing torque within said desired range of closing torque; and determine an amount of current, to be supplied to each said electric motor of each said closing device, to generate current sufficient to produce a closing torque within said desired range of closing torque;

a container filling machine configured to fill containers with a material; and said closing device is configured to close filled containers in a run of containers using the adjusted closing torque to produce closed containers which are openable using an opening torque within the desired range of opening torque.

6. An arrangement for performing a method of testing, determining, and adjusting a closing torque of a container closing machine, said method comprising the steps of:

(A) moving a first container into said container closing machine;

(B) closing said first container by screwing a screw cap or closure using a closing device of said closing machine onto a threaded mouth portion of said first container until a predetermined first closing torque is achieved;

(C) at least partially unscrewing said screw cap or closure using said closing device of said closing machine, and measuring with a measuring arrangement an opening torque used to at least partially unscrew said screw cap or closure;

(D) comparing said measured opening torque from said closing device with a desired range of opening torque and calculating an adjustment of said first closing torque for said closing device to lie within a desired range of closing torque such that, upon said closing device screwing screw caps or closures on containers in a run of containers using a closing torque within said desired range of closing torque, said closed containers are openable using an opening torque within said desired range of opening torque;

(E) adjusting said first closing torque of said closing device to a closing torque within said desired range of closing torque;

repeating steps (A) through (E) for at least one other closing device;

filling and closing containers using said adjusted closing torque to produce closed containers which are openable using an opening torque within said desired range of opening torque;

determining an individual correction of closing torque for each said closing device; and adjusting closing torque for each said closing device with said correction for each said closing device, said arrangement comprises:

a container closing machine comprising a closing device configured to close a container by screwing a screw cap or closure onto a threaded mouth portion of a container until a predetermined first closing torque is achieved, and configured to at least partially unscrew the screw cap or closure;

a measuring arrangement configured to measure the opening torque used to at least partially unscrew the screw cap or closure, and to compare the measured opening torque from said closing device with a desired range of opening torque and calculate an adjustment of the first closing torque for said closing device to lie within a desired range of closing torque such that, upon said closing device screwing screw caps or closures on containers in a run of containers using the adjusted closing torque, the closed containers are openable using an opening torque within the desired range of opening torque;

said measuring arrangement being further configured to adjust the closing torque of said closing device to a closing torque within the desired range of closing torque;

said measuring arrangement being further configured to detect individual characteristics of each said closing device, and to determine, based on said individual characteristics of each said closing device, an individual correction of closing torque for each said closing device, and to adjust closing torque for each said closing device with said correction for each said closing device;

a container filling machine configured to fill containers with a material; and said closing device is configured to close filled containers in a run of containers using the adjusted closing torque to produce closed containers which are openable using an opening torque within the desired range of opening torque.

* * * * *